US007679628B2

(12) United States Patent
Kanai

(10) Patent No.: US 7,679,628 B2
(45) Date of Patent: Mar. 16, 2010

(54) CONTROLLER AND IMAGE DISPLAY DEVICE

(75) Inventor: Izumi Kanai, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 664 days.

(21) Appl. No.: 11/074,773

(22) Filed: Mar. 9, 2005

(65) Prior Publication Data

US 2005/0206660 A1 Sep. 22, 2005

(30) Foreign Application Priority Data

Mar. 10, 2004 (JP) ..... 2004-067459
Mar. 1, 2005 (JP) ..... 2005-055663

(51) Int. Cl.
*G09G 5/10* (2006.01)

(52) U.S. Cl. ..... 345/691; 315/169.3

(58) Field of Classification Search ..... 345/690–699, 345/77, 89, 600, 605; 315/169.3; 358/518, 358/521, 522; 363/21.1, 21.11
See application file for complete search history.

(56) References Cited

U.S. PATENT DOCUMENTS 5,953,002 A * 9/1999 Hirai et al. ..... 345/690
6,646,654 B2 * 11/2003 Takagi ..... 345/690
6,734,875 B1 * 5/2004 Tokimoto et al. ..... 345/690
6,801,178 B2 * 10/2004 Nitta et al. ..... 345/89
6,995,516 B2 * 2/2006 Aoki et al. ..... 315/169.3
2004/0256995 A1 * 12/2004 Takeuchi et al. ..... 315/169.1
2005/0182808 A1 8/2005 Kanai ..... 708/490
2005/0190968 A1 9/2005 Kanai et al. ..... 382/169
2005/0206636 A1 9/2005 Kanai ..... 345/204
2005/0206660 A1 9/2005 Kanai ..... 345/691

FOREIGN PATENT DOCUMENTS

JP 6-178153 6/1994
JP 7-181917 7/1995
JP 2000-39868 2/2000
JP 2001-343957 12/2001
JP 2003-15582 1/2003

* cited by examiner

*Primary Examiner*—Kevin M Nguyen
*Assistant Examiner*—Kenneth B Lee, Jr.
(74) *Attorney, Agent, or Firm*—Fitzpatrick, Cella, Harper & Scinto

(57) ABSTRACT

The present invention discloses a control apparatus. This control apparatus has a modulation circuit, and a control circuit for setting up an amplitude setting signal and/or a pulse width setting signal to be used in the modulation circuit, on the basis of characteristic data representative of characteristics of an input image signal, the amplitude setting signal and/or the pulse width setting signal being used for setting up an amplitude and/or a time width of a pulse signal to be output from the modulation circuit in accordance with a gradient gradation value of the image signal, wherein the modulation circuit is a circuit which uses the time width setting signal and/or the amplitude setting signal as a reference signal for setting up the time width and amplitude of the pulse signal in correspondence with the gradient.

3 Claims, 14 Drawing Sheets

IN CASE THAT THE NUMBER OF IMAGE DATA IS 255

IN CASE THAT THE NUMBER OF IMAGE DATA IS 63

IN CASE THAT THE NUMBER OF IMAGE DATA IS 66

FIG. 4
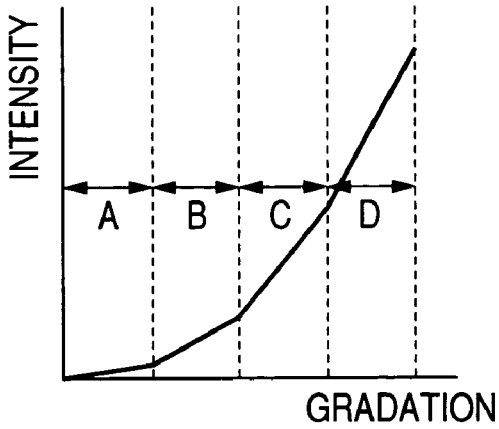
FIG. 5
| | | INPUT | | | |
|---|---|---|---|---|---|
| | | 00 | 01 | 10 | 11 |
| OUTPUT | SC1 | 1 | 0 | 0 | 0 |
| | SC2 | 1 | 1 | 0 | 0 |
| | SC3 | 1 | 1 | 1 | 0 |
| | SC4 | 1 | 1 | 1 | 1 |
FIG. 6
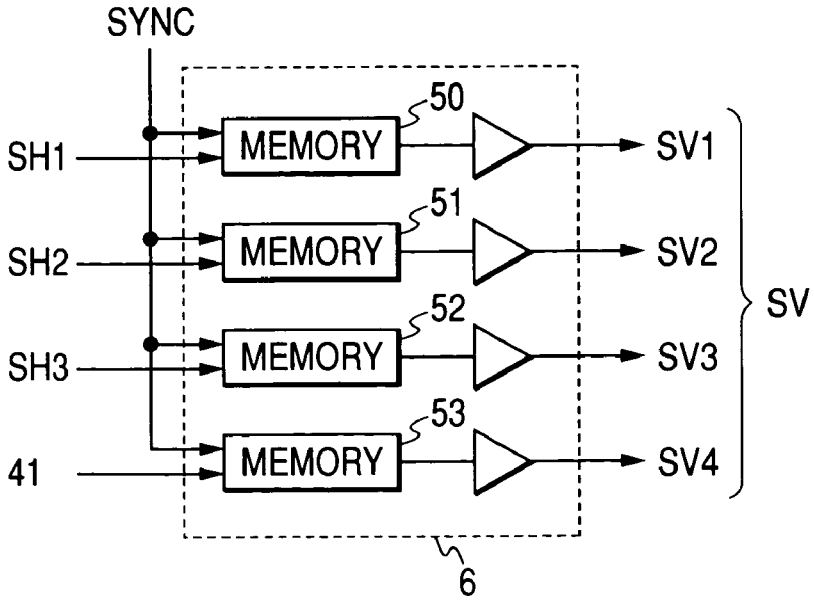

| | | INPUT | | | |
|---|---|---|---|---|---|
| | | 00 | 01 | 10 | 11 |
| OUTPUT | SC1 | 1 | 0 | 0 | 0 |
| | SC2 | 0 | 1 | 0 | 0 |
| | SC3 | 0 | 0 | 1 | 0 |
| | SC4 | 0 | 0 | 0 | 1 |

CONTROLLER AND IMAGE DISPLAY DEVICE

BACKGROUND OF THE INVENTION

1. Field of the Invention

The present invention relates to a controller and an image display device.

2. Related Background Art

For image display devices which change a gamma table in accordance with an input image, for example, the following techniques have been proposed.

Japanese Patent Application Laid-Open No. H06-178153 discloses a gamma correction method of preparing a plurality of gamma tables and selecting one gamma table from the plurality of gamma tables in accordance with a histogram distribution of an input image to correct the gamma value (background art 1). With this method, the gamma table is selected which gives a high contrast to an input image having a high gradation to convert the gradation data of the input image in accordance with the selected gamma table.

Japanese Patent Application Laid-Open No. 2001-343957 discloses a liquid crystal display apparatus wherein the total gradation of brightness of input image data is divided into a plurality of sections, a histogram representative of an occurrence frequency of brightness of the input image data contained in each section is detected, the gradation characteristics are converted so that the contrast of display data in a high occurrence frequency gradation section is emphasized and the contrast in a low occurrence frequency gradation section is suppressed, and a color image is displayed in accordance with the display data having the converted gradation characteristics (background art 2).

The above-described techniques correct the gradation/intensity characteristics of an input signal by converting the gradation data. As a gamma correction method of changing the waveform itself of a drive signal for a display element modulated in accordance with gradation data, Japanese Patent Application Laid-Open No. 2000-39868 discloses an LED display unit which has first intensity modulation means for performing pulse width modulation in accordance with the gradation data and second intensity modulation means for performing gamma correction by using a low pulse current value in an area where a pulse width is narrow and a high pulse current value in an area where a pulse width is wide (background art 3).

The above-described technique discloses of a pulse width modulation method of changing a pulse width in accordance with the gradation data. Japanese Patent Application Laid-Open No. H07-181917 discloses another modulation method using the gradation data. According to this method, signals in a column direction applied to pixels in a selected row are selected from a sequence Vi ($N \geqq 2$, $0 \leqq i \leqq N$) of N+1 voltages increasing their amplitude precisely, and a column selection time is divided equally by S at a time interval of $\Delta t$. An image is displayed at each gradation level by selecting, as the signal applied to each column, (S−j) first voltages Vi and j second voltages Vi+1 (or Vi−1) at respective time intervals (background art 4).

Japanese Patent Application Laid-Open No. 2003-15582 discloses an image display apparatus using an electron source having electron emission elements which has a modulation signal generation unit for modulating the pulse width of a pulse signal for driving an electron emission element, and a voltage of the pulse signal is changed in accordance with whether an average intensity is equal to or higher than a predetermined value.

SUMMARY OF THE INVENTION

The configuration which can control properly a waveform of a modulation signal has long been desired. As the technique of properly controlling the waveform of a modulation signal, the configuration may be adopted in which a digital signal as the basis of generating a modulation signal is corrected and the modulation signal is generated in accordance with the corrected digital signal. The present inventor has paid attention to the issue that a portion of the gradation range is lost by the correction process, which portion can be used otherwise if the correction process is not performed.

An objective of the present invention is to provide a control apparatus capable of properly generating a pulse signal and an image display device capable of properly realizing an image representation.

A control apparatus according to the present invention is constituted in the following manner. The control apparatus comprises: a modulation circuit; and a control circuit for setting up an amplitude setting signal and/or a pulse width setting signal to be used in the modulation circuit, on the basis of characteristic data representative of characteristics of an input image signal, the amplitude setting signal and/or the pulse width setting signal being used for setting up an amplitude and/or a time width of a pulse signal to be output from the modulation circuit on the basis of a gradient of the image signal, wherein the modulation circuit is a circuit which uses the time width setting signal and/or the amplitude setting signal as a reference signal for setting up the time width and amplitude of the pulse signal in correspondence with the gradient.

The characteristic data representative of an input image signal is not required to be data representative of one image signal (Either a digital image signal or an analog image signal. One digital image signal is not limited to one bit but it may have a plurality of significant bits), but the configuration may be adopted preferably in which the characteristic data represents the characteristics of a collection of a plurality of image signals.

For example, in the configuration that the time width setting signal is used as a reference signal, the time width is set in correspondence with the gradient. The configuration may be adopted in which a clock signal is used as the time width setting signal, the time width being set by counting the pulses of the clock signal up to the value corresponding to the gradient. In the configuration that the amplitude setting signal is used as a reference signal, the configuration may be adopted in which an amplitude is set in correspondence with the gradient and the amplitude setting signal is used as a reference amplitude level (corresponding to potentials V1 to V4 to be described later in embodiments) used for setup.

The configuration may be adopted preferably in which: a plurality of sub ranges are set being not completely overlapped, the plurality of sub ranges consisting of respective parts of a range of the gradient capable of being held by the image signal; and the characteristic data has data representative of a density of the image signal in each sub range to which a plurality of image signals forming at least one image are divisionally assigned on the basis of the gradient of each image signal.

The width of each sub range may be different. If the width of each sub range is generally the same (if the width of each sub range is the same or a difference between widths is small (a small difference means $0.95\,A \leqq B \leqq 1.05\,A$ where A is a width of a predetermined sub range and B is the width of other sub ranges)), an image signal constituting an image signal group whose characteristics are evaluated (a plurality of image signals forming at least one image) can be used as data representative of the density indicating an occurrence frequency in each sub range. If the widths of sub ranges are different, the value obtained by dividing the occurrence frequency by the width of each sub range can be used as the density.

The configuration may be adopted more effectively in which: when the time width setting signal and/or the amplitude setting signal is changed from one state that the density has a predetermined value in a first sub range among the plurality of sub ranges to another state that the density in the first range becomes larger, the time width setting signal and/or the amplitude setting signal is changed so that a slope of a gradient-to-brightness characteristic curve in the first sub range becomes steeper, the characteristic curve having as a horizontal axis the gradient and as a vertical axis brightness of a pixel to be driven by the pulse signal output from the modulation circuit.

The pixel driven by the pulse signal means the pixel formed as the result of transmission of energy by the pulse signal. The brightness of the pixel can be measured specifically as an integrated value of the brightness in a predetermined time. In pulse width modulation, the integrated value of brightness in a predetermined proper time (in a line sequential scanning image display apparatus, the predetermined proper time is one horizontal scanning period) is modulated. From the viewpoint of modulation of visual brightness, it is the same as modulation of brightness. In this specification, therefore, the brightness is modulated even by pulse width modulation, unless otherwise specifically described. Therefore, in the following, the intensity means brightness, unless otherwise specifically described.

The configuration may be adopted most preferably in which: the modulation circuit is a circuit for generating, in a first predetermined gradation range, the pulse signals sequentially widening a time width of a portion having a first maximum amplitude corresponding to the first gradation range, in accordance with sequentially incremented gradients, and the pulse signals having maximum amplitudes corresponding to lower gradation range than the first gradation range, in portions other than the portion having the first maximum amplitude; and in a second gradation range on a high gradient side of the first gradation range, the pulse signals sequentially widening a time width of a portion having a second maximum amplitude corresponding to the second gradation range, in accordance with sequentially incremented gradients, and the pulse signals having the second maximum amplitude in portions other than the portion having the first maximum amplitude, wherein the modulation circuit sets up the amplitude setting signal as the reference signal, the amplitude setting signal being set up by the characteristic data using at least one of the first and second amplitudes.

The configuration may be adopted preferably in which: the first gradation range corresponds to one sub range among the plurality of sub ranges and the second gradation range corresponds to another sub range.

The first gradation range corresponds to one sub range means that the first gradation range and one sub range are generally the same (generally the same if a value a value obtained by dividing a difference between the lower limit value of the first gradation range and the lower limit value of the one sub range by the width of the first gradation range is 0.1 or smaller, and if a value a value obtained by dividing a difference between the upper limit value of the first gradation range and the upper limit value of the one sub range by the width of the first gradation range is 0.1 or smaller). The second gradation range corresponds to another sub range means that the second gradation range and the other sub range are generally the same (generally the same if the above-conditions are met). The gradation ranges are not limited only to the first and second gradation ranges, but n (n is 2 or larger, an integer of the value capable of being possessed by gradients or smaller) gradation ranges may be used. However, from the viewpoint of control feasibility, it is preferable to set four gradation ranges, a first lowest gradation range, second, third and fourth gradation ranges.

In the invention first described, the configuration may be adopted preferably in which the characteristic data is data corresponding to a brightness of an image formed by the input image signal.

As the data corresponding to the brightness of an image, data representative of an average value of the brightness of the whole image may be used. The data representative of an average value of the brightness of the whole image may be an average or sum of gradients of a plurality of image signals constituting an image.

The configuration may be adopted in which: for the time width setting signal and/or the amplitude setting signal set up in correspondence with a first state that the characteristic data takes a first value; the time width setting signal and/or the amplitude setting signal set up in correspondence with a state that the characteristic data takes a second value different from the first value, the second value corresponding to an image lower in an average brightness than the average brightness of the image corresponding to the first value is set so that a slope of a gradient-to-brightness characteristic curve becomes larger than the gradient-to-brightness characteristic curve of the first state, in at least a portion of a gradation range lower than a middle value in a range of the gradients capable of being possessed by the image signal, the characteristic curve having as a horizontal axis the gradient and as a vertical axis a brightness of a pixel driven by the pulse signal output from the modulation circuit. The middle value in the range of gradients capable of being possessed by an image signal is a cumulative average of the lower and upper limit values in the range of gradients capable of being possessed by the image signal.

The configuration may be adopted preferably in which: for the time width setting signal and/or the amplitude setting signal set up in correspondence with a first state that the characteristic data takes a first value; the time width setting signal and/or the amplitude setting signal set up in correspondence with a state that the characteristic data takes a second value different from the first value, the second value corresponding to an image higher in an average brightness than the average brightness of the image corresponding to the first value is set so that a slope of a gradient-to-brightness characteristic curve becomes larger than the gradient-to-brightness characteristic curve of the first state, in at least a portion of a gradation range lower than a middle value in a range of the gradients capable of being possessed by the image signal, the characteristic curve having as a horizontal axis the gradient and as a vertical axis a brightness of a pixel driven by the pulse signal output from the modulation circuit.

The present application also includes an invention of an image display device comprising: the control apparatus; and a display having display elements to which the pulse signal output from the modulation circuit of the control apparatus is applied.

The configuration may be adopted preferably in which: the display has a plurality of scan wires, a plurality of modulation wires and a plurality of display elements interconnected in a matrix shape by the scan wires and the modulation wires; and the modulation circuit is a circuit for sequentially outputting the pulse signal set up in correspondence with the gradient of the image signal corresponding to each display element, via one modulation wire to a plurality of display elements connected in common to the modulation wires and connected to respective different scan wires, synchronously with sequential selection of the plurality of scan wires.

The configuration may further be adopted preferably in which the modulation circuit is a circuit for outputting the pulse signal set up in correspondence with the gradient of the image signal corresponding to each display element, via the plurality of modulation wires to the plurality of display elements connected to the plurality of modulation wires and connected to a selected scan wire.

According to the present inventions, a proper pulse signal can be realized.

BRIEF DESCRIPTION OF THE DRAWINGS

FIG. 4 is a graph showing the gradation/intensity characteristics of a light emitting element.

FIG. 5 is a table showing inputs and outputs of a decoder.

FIG. 6 is an illustrative diagram of a voltage setup unit.

DESCRIPTION OF THE PREFERRED EMBODIMENTS

First Embodiment

Pulse Width Modulation Priority Type Multivalue PWM

Figure 1:
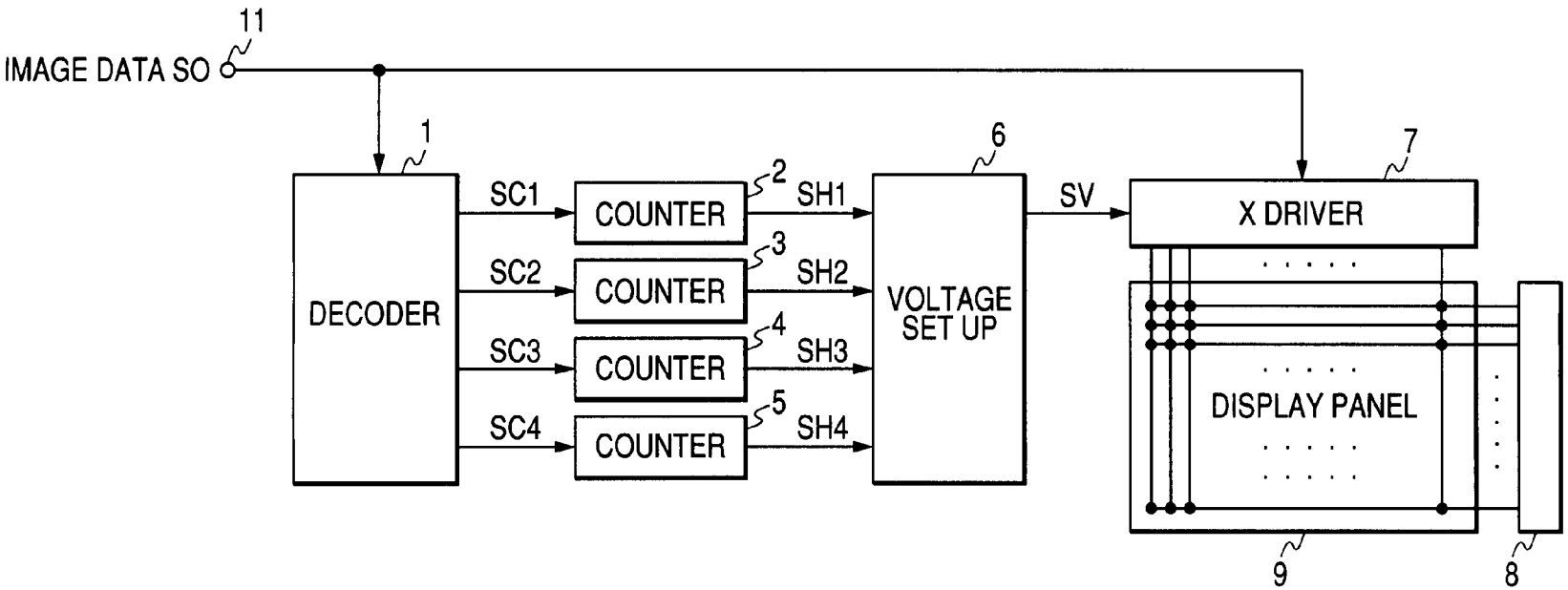
FIG. 1 is a circuit block diagram according to a first embodiment.

FIG. 1 is a circuit block diagram of an image display device according to the first embodiment of the present invention. In FIG. 1, reference numeral 11 represents an input signal terminal, reference numeral 1 represents a decoder, reference numerals 2 to 5 represent counters, reference numeral 6 represents a voltage setup circuit, reference numeral 7 represents an X-driver, reference numeral 8 represents a Y-driver, and reference numeral 9 represents a display panel. The decoder 1 and counters 2 to 5 constitute a brightness evaluation circuit, and the voltage setup circuit 6 constitutes an input/output conversion characteristics deflection circuit. The voltage setup circuit 6 and X-driver constitute a driver circuit, and the display panel 9 constitutes a display panel 9.

A plurality of light emitting elements' is disposed in a matrix shape in the display panel 9 and driven line sequentially. The light emitting element may be an electron emitting element (a combination of an electron emitting element and a phosphor member) such as an element using a cold cathode element, or may be an electroluminescence element, a plasma display element, a liquid crystal display element or the like.

Figure 2:
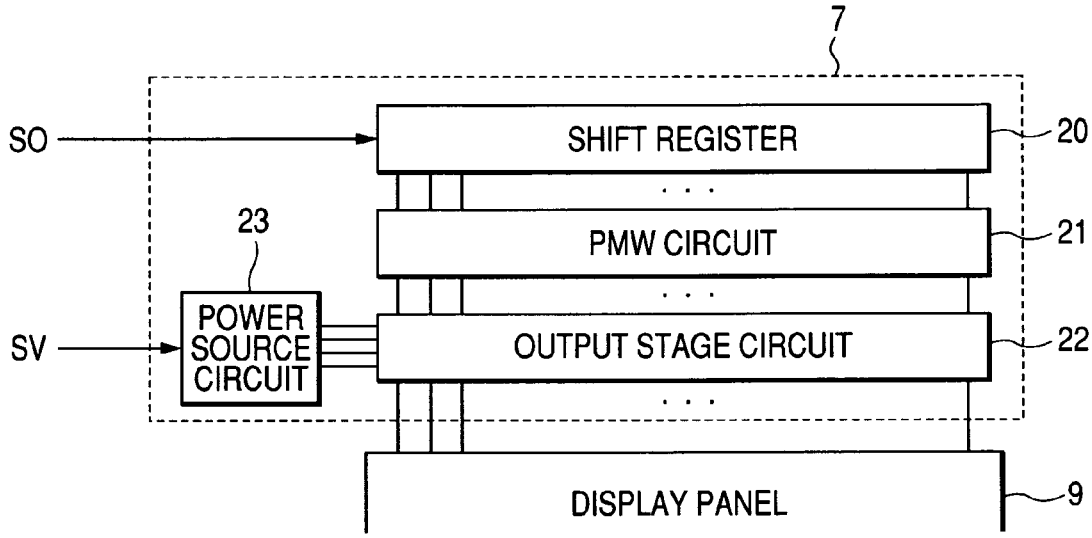
FIG. 2 is an illustrative diagram of an X-driver.

FIG. 2 is a diagram showing an example of the X-driver shown in FIG. 1. In FIG. 2, reference numeral 20 represents a shift resister, reference numeral 21 represents a PWM circuit, reference numeral 22 represents an output stage circuit, and reference numeral 23 represents a power source circuit. The PWM circuit 21 and output stage circuit 22 constitute a modulating circuit. The decoder 1, counters 2 to 5, voltage setup circuit 6 and power source circuit 23 constitute a control circuit.

Input image data S0 is input to the shift register 20 and subjected to serial-parallel conversion. The shift register 20 makes the image data of one row be subjected to serial-parallel conversion and outputs the parallel data to the PWM circuit.

The PWM circuit 21 has a latch circuit which holds image data of one row output from the shift register for one horizontal sync period (hereinafter called 1H). The PWM circuit 21 converts the image data of one row into pulse width modulation signals (hereinafter called PWM signals).

Figure 3A:
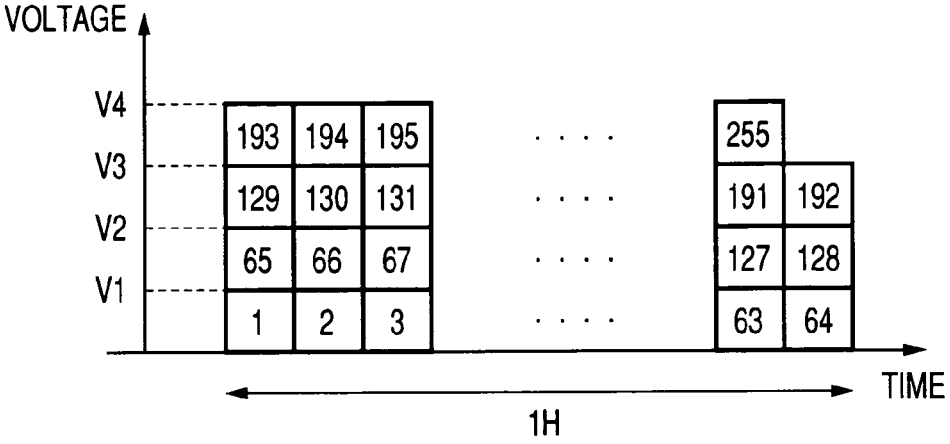
FIGS. 3A, 3B and 3C show drive voltage waveforms according to the first embodiment.
Figure 3B:
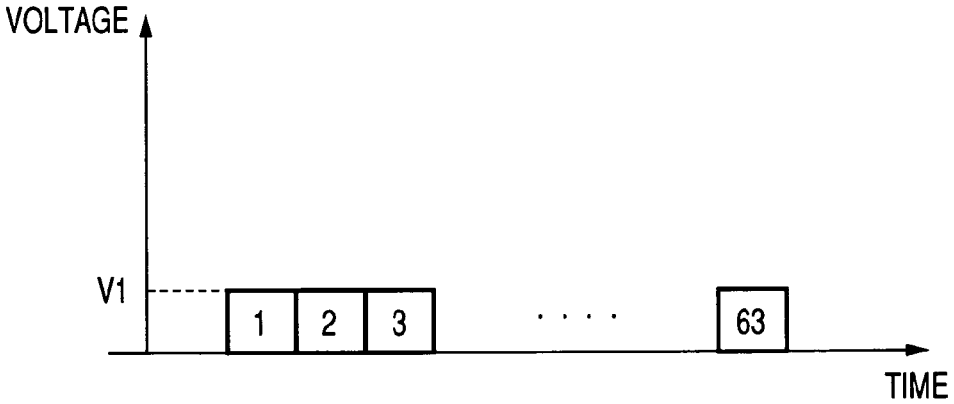
Figure 3C:
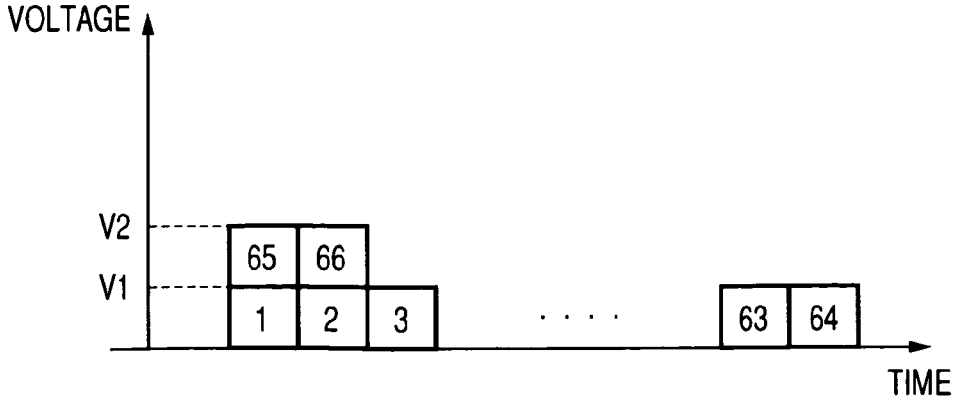

This embodiment assumes pulse width modulation priority type multivalue PWM. FIGS. 3A to 3C illustrate the pulse width modulation priority type multivalue PWM. FIGS. 3A to 3C also illustrate voltage waveforms of image data constituted of 8-bit data from "0" to "255," the image data being applied to each light emitting element of the display panel. The abscissa of the diagram represents time and the ordinate represents a voltage applied to each light emitting element.

As shown in FIG. 3A, the embodiment assumes that a potential applied to the light emitting element from the modulation circuit is a four-value (V1, V2, V3 and V4). A difference between the potential applied from the modulation circuit and the potential of a select signal applied from the Y driver 8 as a scanner circuit is applied via a modulation wiring and a scanning wiring to each element as a drive voltage. In this embodiment, the configuration that the potential of the select signal is 0 V is adopted. The voltage waveform shown in FIG. 3A is for the image data having a value "255." As shown, a voltage C4 is applied to the light emitting element during slots up to the 63rd slot and a voltage V3 is applied only during the 64th slot, respectively for the image data "255."

The voltage waveform shown in FIG. 3B is for the image data having a value "63." As shown, for the image data "0" to "64," the voltage V1 is applied fixedly to effect pulse width modulation corresponding to image data.

The voltage waveform shown in FIG. 3C is for the image data having a value "66." As shown, the voltage V2 is applied to the light emitting element during the slots up to the 2nd slot and thereafter the voltage V1 is applied starting from the 3rd slot.

The pulse width priority type PWM of the embodiment divides gradation into four blocks (four sub-ranges): "0" to "64," "65" to "128," "129" to "192" and "193" to "255." Each gradation block have a different maximum voltage to be applied to the light emitting element, and in each gradation block a pulse-width modulated voltage waveform is used (the duration of the maximum voltage in each gradation block is sequentially prolonged as the gradient increases).

The embodiment assumes four-value pulse width modulation priority type PWM. An output of the PWM circuit 21 is a PWM signal corresponding to each of the potential values V1 to V4. Therefore, one output terminal of the PWM circuit 21 can output four PWM signals corresponding to V1 to V4. The potential V1 to V4 corresponds to an amplitude setup signal.

A PWM signal output from the PWM circuit 21 is input to the output stage circuit 22. The output stage circuit 22 outputs each potential to the modulation wiring of the display panel during a period designated by the PWM signal corresponding to each potential V1 to V4.

The power source circuit 23 has four power source units corresponding to V1 to V4 and supplies potentials V1 to V4 to the output stage circuit 22, as the reference signals for setting the amplitude of each pulse signal. A potential setup signal SV is input to the power source circuit 23. In accordance with the potential setup signal SV, the gains for the outputs from the four power sources are controlled to regulate the outputs to have the output potentials V1 to V4. The details of the potential setup signal SV will be later given.

FIG. 4 shows the gradation/intensity characteristics when a light emitting element is driven by the voltage waveform such as shown in FIGS. 3A to 3C. The abscissa of FIG. 4 represents a gradation of image data, and the ordinate represents an intensity (brightness). As shown, in the pulse width modulation priority type PWM, the gradation is divided into four blocks and has the characteristic that the intensity changes linearly in each gradation block. In this example, four gradation blocks A, B, C and D are shown. The block A corresponds to the gradation "0" to "64," and this image data is input, the light emitting element is driven at the voltage V1. The block B corresponds to the gradation "65" to "128," and this image data is input, the light emitting element is driven at the voltage V2 or V1. The block C corresponds to the gradation "129" to "192," and this image data is input, the light emitting element is driven at the voltage V3 or V2. The block D corresponds to the gradation "193" to "255," and this image data is input, the light emitting element is driven at the voltage V4 or V3.

In each of the gradation blocks A, B, C and D, modulation equivalent to simple pulse width modulation is performed so that the gradation/intensity characteristics are linear. The total gradation characteristics "0" to "255" are therefore indicated by a polygonal line such as shown in FIG. 4.

The voltages V1 to V4 shown in FIG. 3 satisfy the relation (equal voltage division) V1−0=V2−V1=V3−V2=V4−V3, where 0 V corresponds to a black level. It is assumed that this division can obtain the polygonal line of standard gamma characteristics (e.g., $\gamma=2.2$) shown in FIG. 4. If only the voltage V1 is made high, the gradation/intensity characteristics of the gradation A have a large inclination, whereas if only the voltage V1 is made low, the gradation/intensity characteristics of the gradation A have a small inclination. In this embodiment, by controlling the voltages V1 to V4, the inclination of the gradation/intensity characteristics of each gradation block can be changed.

Next, with reference to FIG. 1, a gamma correction method will be described.

It is assumed that image data applied to the input terminal 11 is AD converted 8-bit data. The upper two bits of the image data of 8 bits are input to the decoder 1. The decoder 1 converts the two-bit data "00," "01," "10" and "11" into four bit signals SC1 to SC4, and outputs them to the counters 2, 3, 4 and 5.

FIG. 5 shows the inputs and outputs of the decoder 1. The inputs to the decoder 1 is two-bit data "00," "01," "10" and "11," and the outputs from the decoder 1 is four-bit data SC1, SC2, SC3 and SC4. SC1, SC2, SC3 and SC4 are input to the counters 2, 3, 4 and 5, respectively.

The counters 2, 3, 4 and 5 count the four-bit signals SC1 to SC4 output from the decoder 1 to generate cumulative histograms SH1 to SH4. Namely, the counters 2, 3, 4 and 5 count the number of image data "0" to "63," "0" to "127," "0" to "191" and "0" to "255," respectively.

FIG. 6 is the diagram showing the details of the voltage setup circuit 6. The cumulative histogram data SH1 to SH4 counted by the counters 2 to 5 is stored in memories 50 to 53, being updated at proper timings. When the cumulative histograms of image data of one frame are counted, a control signal Sync is input to the memories to output the stored data and thereafter the memories are reset to 0. In this manner, the memories output the cumulative histogram data of one frame. This cumulative histogram data constitutes the characteristic data corresponding to the image signals of one frame. The characteristic data is not limited to be obtained from image signals of one frame. For example, if an image is formed in the field unit base, the characteristic data may be obtained from image signals of one field, or it may be obtained from image signals of several fields or several frames.

An output of the memory 53 is the cumulative histogram of image data "0" to "255" and coincident with the number of all pixels of the image data.

In this embodiment, for the convenience of description, the configuration is adopted in which the counter 5 counts the cumulative histogram of image data "0" to "255." Actually, if the cumulative histogram of image data "0" to "255" is counted in one frame, this histogram coincides with the number of all pixels so that the counter 5 and memory 53 may be omitted.

The cumulative histogram data output from the memories 50 to 53 is subjected to gain control to generate voltage setup signals SV1, SV2, SV3 and SV4. The relation between the cumulative histograms SH1 to SH4 and the voltage setup signals SV1 to SV4 are therefore: the larger the cumulative histograms SH1, SH2, SH3 and SH4, the higher the voltage setup signals SV1, SV2, SV3 and SV4, respectively. The gain control may be performed by considering information such as brightness adjustment and contrast adjustment.

The voltage setup signals SV1, SV2, SV3 and SV4 control potential values V1, V2, V3 and V4 of the power source circuit. The potential values are controlled in the manner: the higher the voltage setup signals SV1, SV2, SV3 and SV4, the higher the potential values V1, V2, V3 and V4, respectively.

According to the display method of this embodiment, the higher the potential values V1, V2, V3 and V4, the larger the inclination of the gradation blocks A, B, C and D shown in FIG. 4, respectively.

In this embodiment, the voltage setup signals SV1 to SV4 are used for controlling the potential values V1 to V4. Alternatively, the voltage setup signals SV1 to SV4 may be DA converted and the DA converted signals are used directly as the potential values V1 to V4. Namely, various configurations are possible if the amplitude setup signals V1 to V4, to be used as the reference signals for setting the amplitude of a pulse signal output from the modulation circuit, are set in accordance with the characteristic data.

Next, the gamma correction process will be described with reference to FIGS. 7A to 7D and 8A to 8D.

Figure 7A:
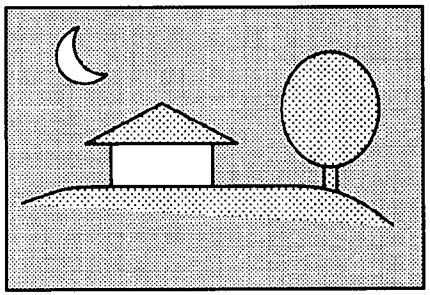
FIGS. 7A, 7B, 7C and 7D are diagrams illustrating an example of a gamma correction process according to the first embodiment.
Figure 7B:
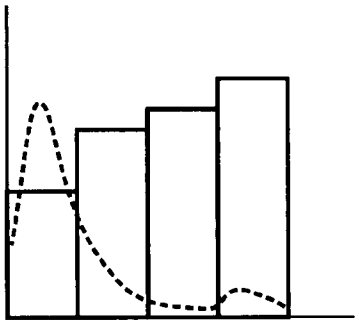

FIGS. 7A to 7D illustrate an example of the gamma correction process when a dark image is input. FIG. 7A shows an input image. In FIG. 7B, a broken line indicates a histogram of the input image shown in FIG. 7A, and a bar graph corresponds to the cumulative histograms of the input image. The cumulative histograms are outputs of the memories 50 to 53 shown in FIG. 6.

The cumulative histogram data is converted into the voltage setup signals SV1 to SV4 by the voltage setup unit 6. In accordance with the voltage setup signals, the power source circuit adjusts the potential values V1 to V4 so that they have the designated values.

Figure 7C:
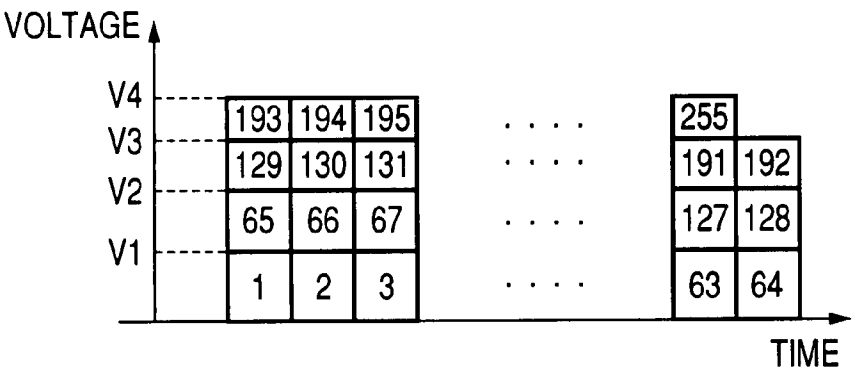

For example, when a dark image such as shown in FIG. 7A is input, the histogram has the shape indicated by the broken line shown in FIG. 7B and the cumulative histograms become the bar graph shown in FIG. 7B. Namely, the darker the gradation, the increase amount of the cumulative histograms becomes larger. In this case, as shown in FIG. 7C, the voltage waveforms applied to a light emitting element have the relation that V1−0 and V2−V1 are higher than those shown in FIG. 3A and V3−V2 and V4−V3 are lower than those shown in FIG. 3A.

Figure 7D:
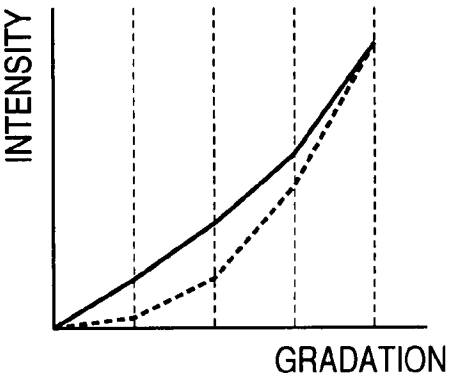

As the light emitting element is driven by these voltage waveforms, the gradation/intensity characteristics of the light emitting element are those shown in FIG. 7D. Namely, the darker the gradation, the higher the contrast. A broken line shown in FIG. 7D indicates the gradation/intensity characteristics of the standard state (e.g., $\gamma=2.2$).

Figure 8A:
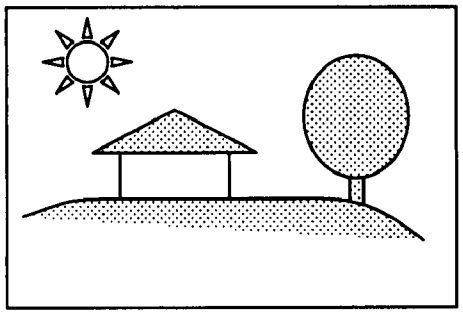
FIGS. 8A, 8B, 8C and 8D are diagrams illustrating another example of a gamma correction process according to the first embodiment.

FIGS. 8A to 8D illustrate an example of the gamma correction process when a bright image is input. FIG. 8A shows an input image. Similar to FIG. 7B, a broken line in FIG. 8B indicates a histogram, and a bar graph corresponds to the cumulative histograms.

Figure 8B:
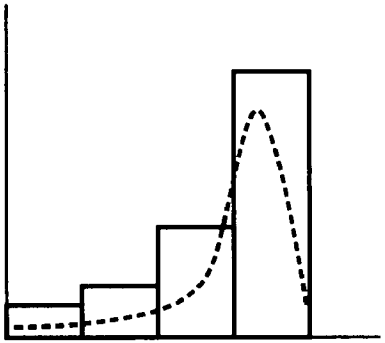
Figure 8C:
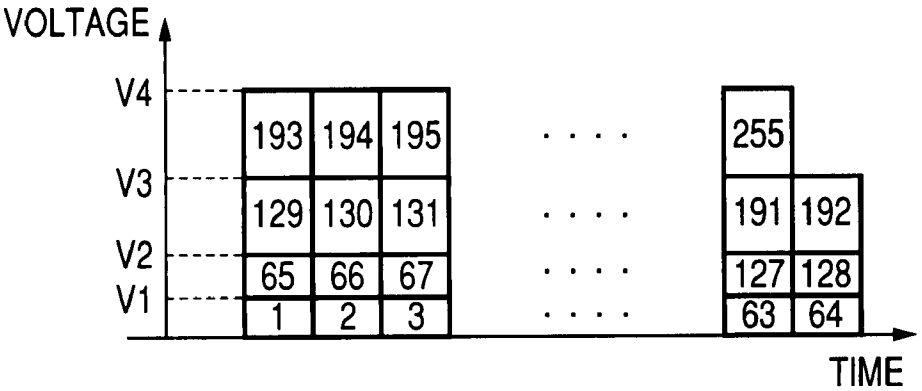

When a bright image such as shown in FIG. 8A is input, the histogram has the shape indicated by the broken line shown in FIG. 8B and the cumulative histograms become the bar graph shown in FIG. 8B. Namely, the brighter the gradation, the increase amount of the cumulative histograms becomes larger. In this case, as shown in FIG. 8C, the voltage waveforms applied to a light emitting element have the relation that V1−0 and V2−V1 are lower than those shown in FIG. 3A and V3−V2 and V4−V3 are higher than those shown in FIG. 3A.

Figure 8D:
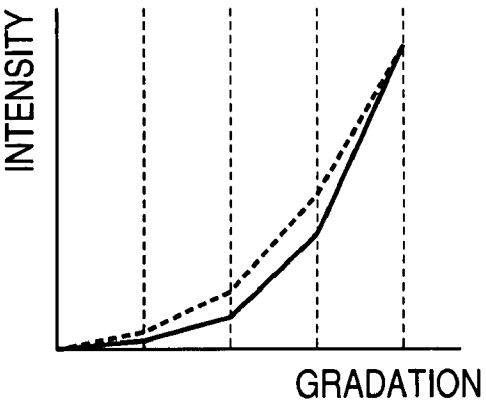

As the light emitting element is driven by these voltage waveforms, the gradation/intensity characteristics of the light emitting element become as shown in FIG. 8D. Namely, the brighter the gradation, the higher the contrast.

By giving a higher contrast to the gradation block having a larger increase amount of the cumulative histograms, the input image can be displayed always at a good contrast matching the image.

As the present invention is applied as in the above embodiment, it is not necessary to use a gamma correction table so that the circuit scale can be made small. Since the gamma is corrected by analog voltage, insufficient gradation of conventional gamma correction can be avoided. In the above embodiment, the configuration is adopted in which the gradation ranges of pulse signals having the maximum amplitudes of V1, V2, V3 and V4 coincide with the sub-ranges for counting the histograms. The gradation range is not necessarily required to be coincident with the sub-range. In this case, an additional digital process or the like may be used to reduce display state discontinuity between the gradation ranges. Also in this case, insufficient gradation by the digital signal process can be suppressed more than the case that the prevent invention is not adopted.

Second Embodiment

Pulse Width Modulation Priority Type Multivalue PWM

Figure 9:
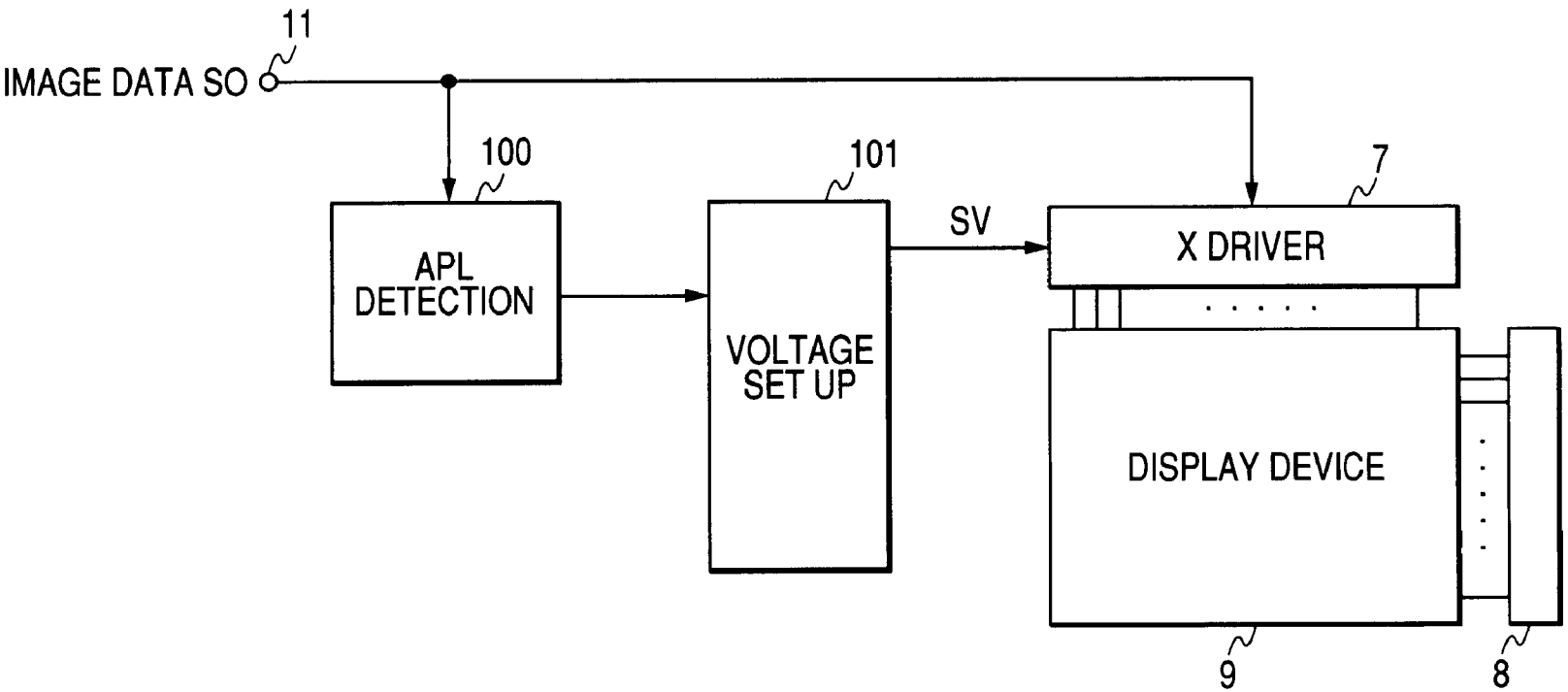
FIG. 9 is a circuit block diagram according to a second embodiment.

FIG. 9 is a circuit block diagram of an image display device according to the second embodiment of the present invention. Like elements to those shown in FIG. 1 are represented by identical reference numerals. In FIG. 9, reference numeral 100 represents an APL detection unit, and reference numeral 101 represents a voltage setup unit. The APL detection unit 100 constitutes a brightness evaluation circuit for evaluating a brightness of an image.

The APL detection unit 100 detects APLs of image data of one frame. The detected APLs are input to the voltage setup unit 101.

The voltage setup unit 101 has an unrepresented ROM which outputs the voltage setup values SV1, SV2, SV3 and SV4 by using APls as addresses. The power source circuit in the X driver outputs the potentials V1 to V4 in accordance with the voltage setup values SV1 to SV4. Each light emitting element is driven by the potentials V1 to V4. The potentials V1 to V4 correspond to the amplitude setup signals.

Next, with reference to FIGS. 10A and 11D, an example of a gamma correction process will be described.

Figure 10A:
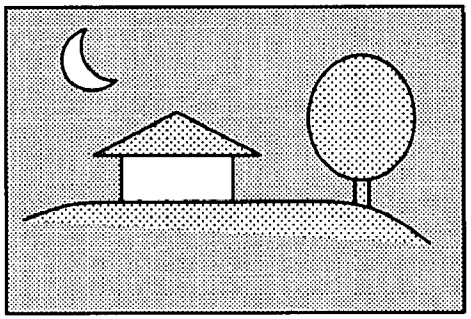
FIGS. 10A, 10B and 10C are diagrams illustrating an example of a gamma correction process according to the second embodiment.

FIGS. 10A to 10D illustrate an example of the gamma correction process when a dark image is input. APL takes a low value for a dark image such as shown in FIG. 10A. By using input APLs as addresses, the voltage setup circuit 101 outputs four voltage setup values SV1 to SV4. In accordance with the voltage setup values SV1 to SV4, the power source circuit in the X driver sets V1 to V4.

Figure 10B:
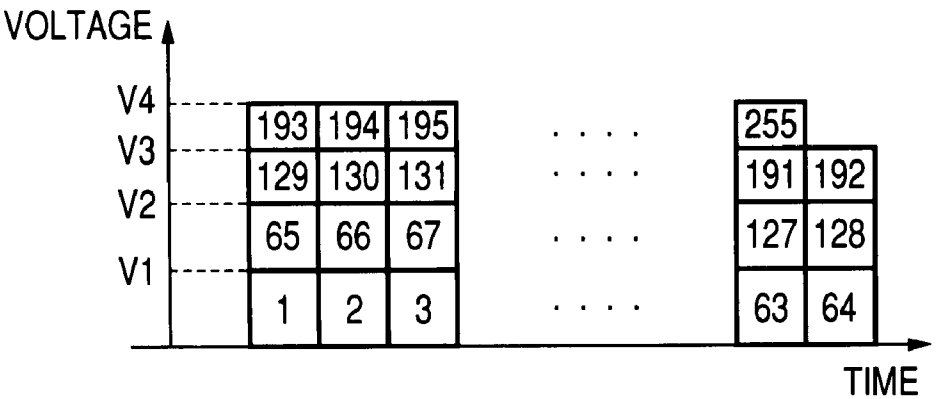
Figure 10C:
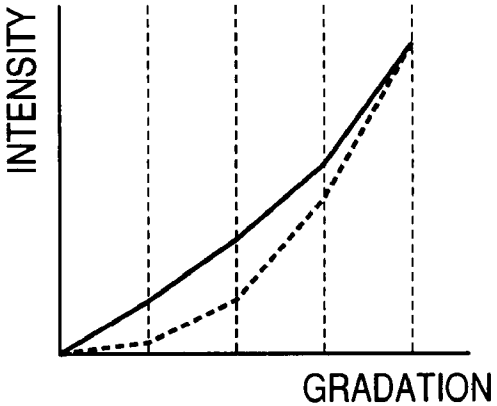

For a dark image such as shown in FIG. 10A, as shown in FIG. 10B the voltage waveforms applied to a light emitting element have V1−0 and V2−V1 higher than those shown in FIG. 3A and V3−V2 and V4−V3 lower than those shown in FIG. 3A. Therefore, the gradation/intensity characteristics of a light emitting element become as shown in FIG. 10C. Namely, in the gradation range lower than near the middle value (gradient "128"), the inclination of the characteristic curve becomes large to give a higher contrast to a darker gradation.

Figure 11A:
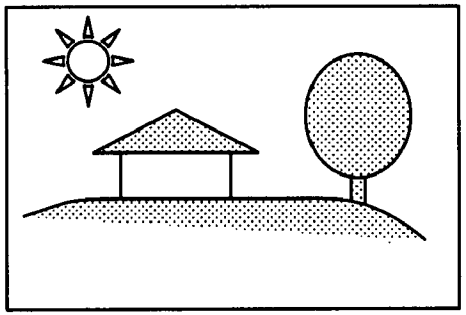
FIGS. 11A, 11B and 11C are diagrams illustrating another example of a gamma correction process according to the second embodiment.

FIGS. 11A to 11D illustrate an example of a gamma correction process when a bright image is input. APL takes a high value for a bright image such as shown in FIG. 11A.

Figure 11B:
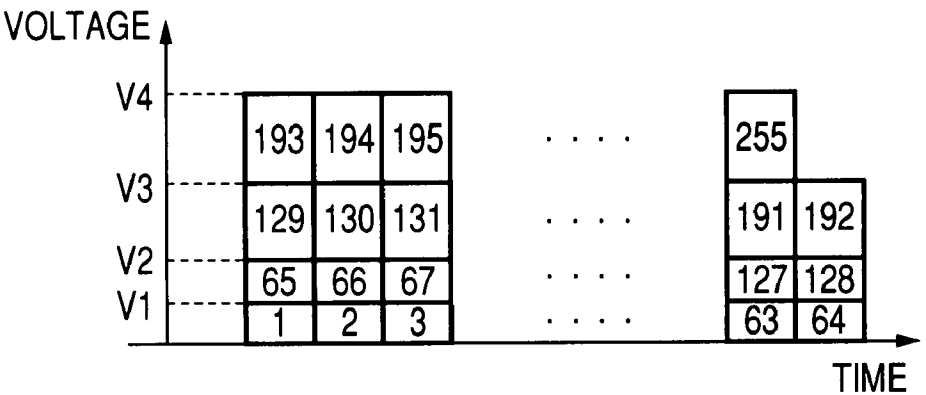
Figure 11C:
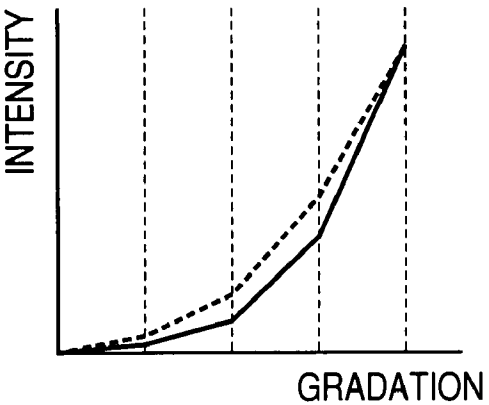

For a bright image, as shown in FIG. 11B the voltage waveforms applied to a light emitting element have V1−0 and V2−V1 lower than those shown in FIG. 3A and V3−V2 and V4−V3 higher than those shown in FIG. 3A. Therefore, the gradation/intensity characteristics of a light emitting element become as shown in FIG. 11C. Namely, in the gradation range higher than near the middle value, the inclination of the characteristic curve becomes large to give a higher contrast to a brighter gradation.

In this manner, the input image can be displayed always at a good contrast matching the image.

According to the present invention, it is not necessary to use a gamma correction table so that the circuit scale can be made small. Since the gamma is corrected by analog voltage, insufficient gradation can be avoided.

Third Embodiment

Voltage Modulation Priority Type Multivalue PWM

Figure 12:
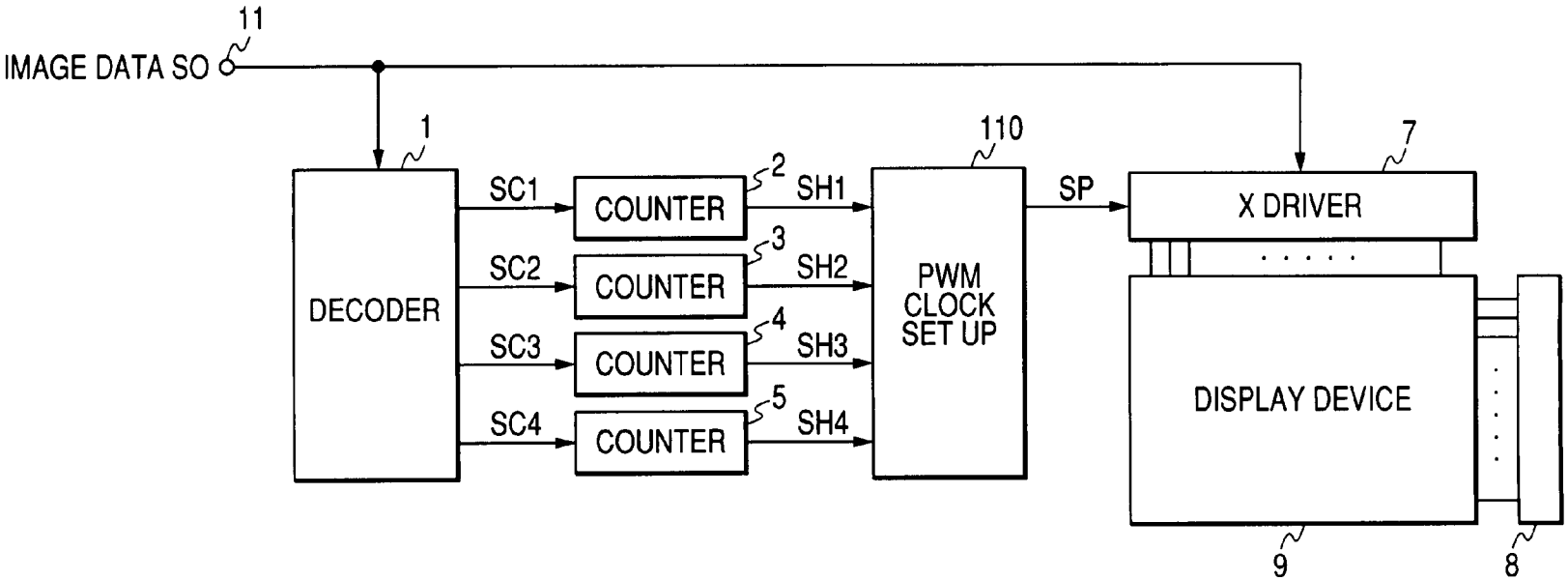
FIG. 12 is a circuit block diagram according to a third embodiment.

FIG. 12 is a circuit block diagram of an image display device according to the third embodiment of the present invention. Like blocks to those shown in FIG. 1 are represented by identical reference numerals. In FIG. 12, reference numeral 110 represents a PWM clock setup unit which constitutes an input/output conversion characteristic change circuit. The PWM clock setup unit 110 and X driver 7 constitute a driver circuit.

Figures 13, 14:
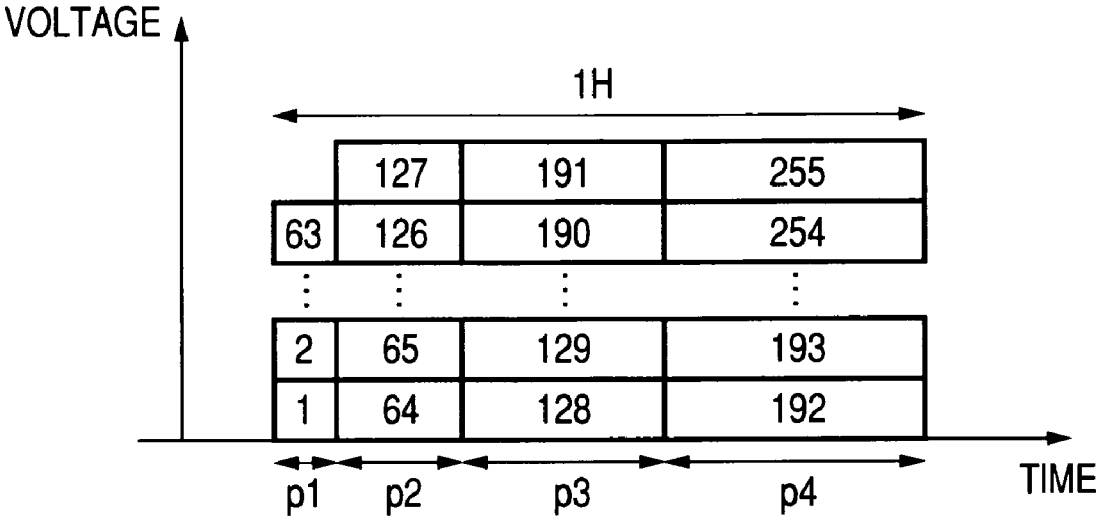
FIG. 13 shows drive voltage waveforms according to the third embodiment.
FIG. 14 is a table showing inputs and outputs of a decoder.

FIG. 13 shows a voltage waveform to be used for displaying image data of 8 bits by an embodiment driving method. This embodiment assumes voltage (amplitude) modulation priority type multilevel PWM shown in FIG. 13. In this embodiment, 1H is divided into four slots. The first, second, third and fourth slots are driven by pulse widths p1, p2, p3 and p4, respectively. In each slot (gradation block), gradation representation is performed through voltage (amplitude) modulation. This driving provides the standard gradation/intensity characteristics (e.g., $\gamma$=2.2) of a light emitting element such as shown in FIG. 4.

Next, the operation of this embodiment will be described. It is assumed that image data applied to the input terminal 11 is AD converted 8-bit data. The upper two bits of the image data of 8 bits are input to the decoder 1. The decoder 1 converts the two-bit data "00," "01," "10" and "11" into four bit signals SC1 to SC4, and outputs them to the counters 2, 3, 4 and 5.

FIG. 14 shows the inputs and outputs of the decoder 1. The inputs to the decoder 1 is two-bit data "00," "01," "10" and "11," and the outputs from the decoder 1 is four-bit data SC1, SC2, SC3 and SC4. SC1, SC2, SC3 and SC4 are input to the counters 2, 3, 4 and 5, respectively.

The counters 2, 3, 4 and 5 count the outputs of the decoder 1 to generate histograms SH1 to SH4.

The counted histograms SH1 to SH4 are input to the PWM clock setup unit 110. In accordance with the histograms SH1 to SH4, the PWM clock setup unit 110 outputs a PWM clock setup signal SP for controlling the pulse widths p1 to p4, to the X driver 7. The signal for setting the pulse widths p1 to p4 corresponds to a time width setup signal used as the reference signal for setting the time width of a pulse signal.

The PWM clock setup unit 110 generates the PWM clock setup signal SP so that the larger the histograms SH1, SH2, SH3 and SH4, the pulse widths p1, p2, p3 and p4 are set longer, respectively.

The X driver 7 has therein a PWM circuit which sets the pulse widths p1 to p4 in accordance with the PWM clock setup signal SP. In accordance with the setup pulse widths, the X driver 7 generates a drive voltage waveform and drives each light emitting element.

Next, an example of the gamma correction process will be described with reference to FIGS. 15A to 15D and 16A to 16D.

Figure 15A:
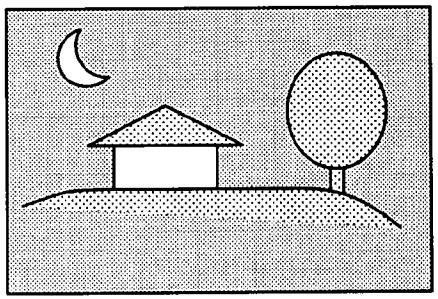
FIGS. 15A, 15B, 15C and 15D are diagrams illustrating an example a gamma correction process according to the third embodiment.
Figure 15B:
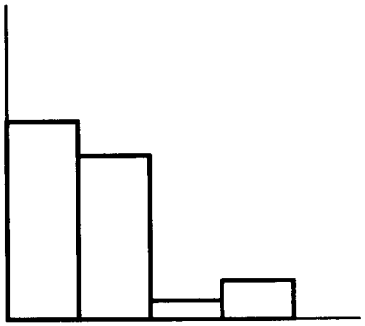

FIGS. 15A to 15D illustrate an example of the gamma correction process when a dark image is input. FIG. 15A shows an input image. The decoder 1 and counters 2 to 5 count histograms SH1 to SH4 of the image shown in FIG. 15A. FIG. 15B is a histogram of the image shown in FIG. 15A.

The counted histogram data SH1 to SH4 is converted into the PWM clock setup signal SP. In accordance with the PWM clock setup signal SP, the X driver sets the pulse widths p1 to p4.

Figure 15C:
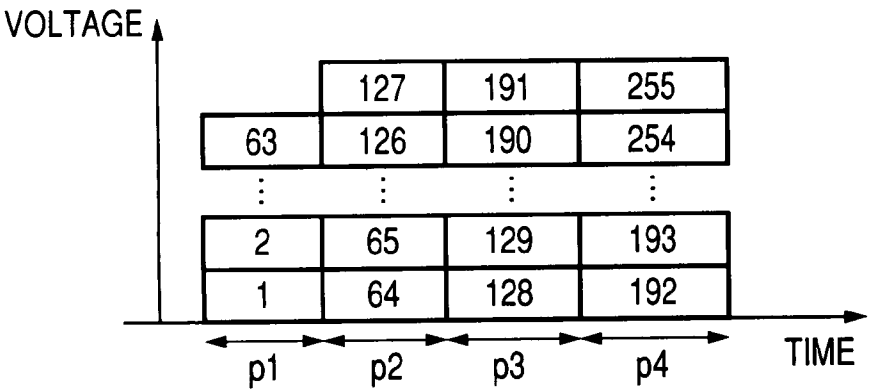
Figure 15D:
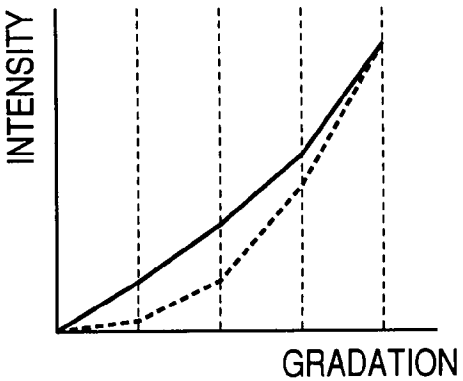

The voltage waveform applied to each light emitting element when the image shown in FIG. 15A is input is shown in FIG. 15C. As shown, the pulse widths p1 and p2 are longer and the pulse widths p3 and p4 are shorter, than those shown in FIG. 13. The gradation/intensity characteristics of a light emitting element become therefore as shown in FIG. 15D. Namely, a higher contrast is given to a darker gradation.

Figure 16A:
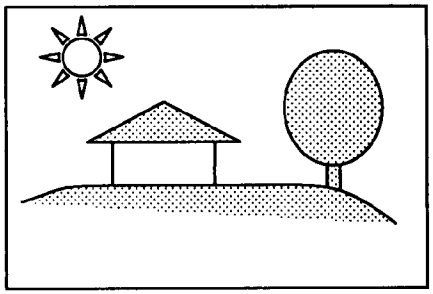
FIGS. 16A, 16B, 16C and 16D are diagrams illustrating another example of a gamma correction process according to the third embodiment.
Figure 16B:
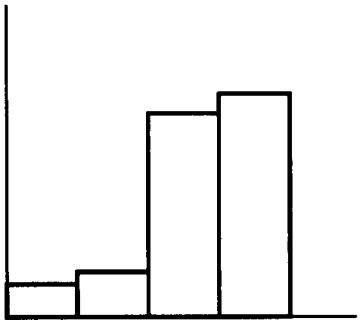

FIGS. 16A to 16D illustrate an example of the gamma correction process when a bright image is input. FIG. 16A shows an input image, and FIG. 16B shows histograms. In accordance with the input histogram data SH1 to SH4, the PWM clock setup unit 110 generates and outputs the PWM clock setup signal SP to the X driver. In accordance with the PWM clock setup signal SP, the X driver sets the pulse widths p1 to p4.

Figure 16C:
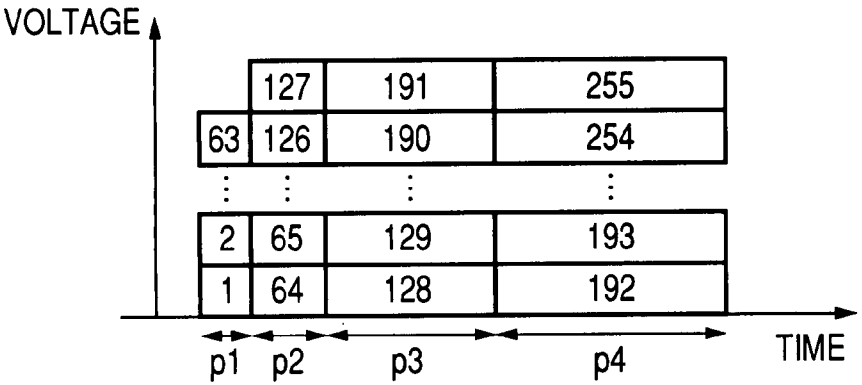
Figure 16D:
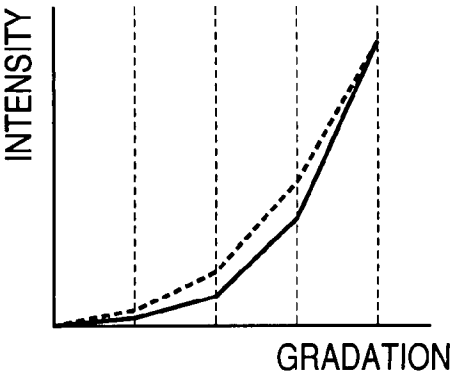

The voltage waveform applied to each light emitting element when the image shown in FIG. 16A is input is shown in FIG. 16C. As shown, the pulse widths p1 and p2 are shorter and the pulse widths p3 and p4 are longer, than those shown in FIG. 13. The gradation/intensity characteristics of a light emitting element become therefore as shown in FIG. 16D. Namely, a higher contrast is given to a brighter gradation.

By giving a higher contrast to the gradation block having a larger histogram, the input image can be displayed always at a good contrast matching the image.

As the present invention is applied as in the above embodiment, it is not necessary to use a gamma correction table so that the circuit scale can be made small. Since the gamma is corrected by analog voltage, insufficient gradation can be avoided.

REFERENCE EXAMPLE

PWM

As a reference example, description will be made on a gamma correction when a light emitting element is driven through voltage fixed PWM. The circuit block diagram of the reference example is the same as that of the third embodiment shown in FIG. 12.

Figure 17:
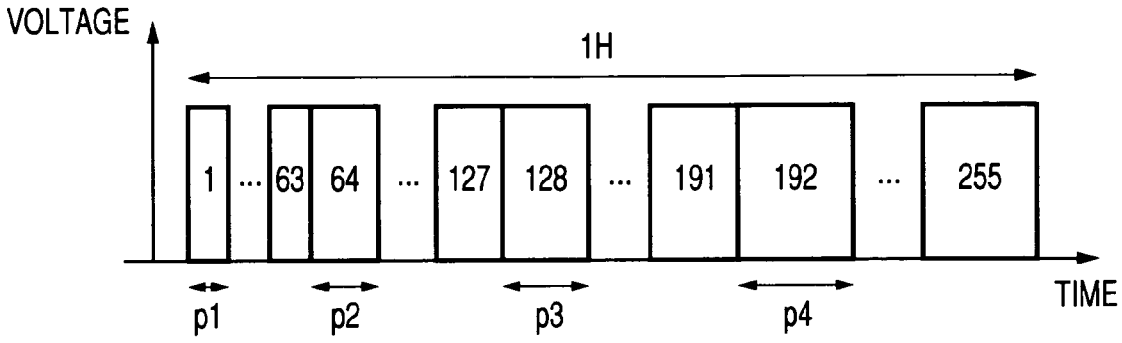
FIG. 17 shows comparative drive voltage waveforms.

FIG. 17 shows a drive voltage waveform of the reference example. In this reference example, the gradation is divided into four blocks "0" to "63," "64" to "127," "128" to "191" and "192" to "255," and each gradation block has a voltage waveform having a different pulse width. The pulse width of one slot of the gradation "0" to "63" is set to p1, the pulse width of one slot of the gradation "64" to "127" is set to p2, the pulse width of one slot of the gradation "128" to "191" is set to p3, and the pulse width of one slot of the gradation "192" to "255" is set to p4.

In a standard case, the pulse widths p1 to p4 are set as shown in FIG. 17 and the standard gradation/intensity characteristics (e.g., $\gamma$=2.2) of a light emitting element become as shown in FIG. 3.

Next, the operation of the reference example will be described with reference to FIG. 12.

Similar to the third embodiment, histograms SH1 to SH4 are calculated in accordance with the upper two bits of image data and input to the PWM clock setup unit 110. In accordance with the histograms SH1 to SH4, the PWM clock setup unit 110 generates and outputs the PWM clock setup signal SP for controlling the pulse widths p1 to p4, to the X driver 7. The pulse widths p1 to p4 correspond to drive signal waveform parameters.

In this case, the PWM clock setup unit 110 generates the PWM clock setup signal SP so that the larger the histograms SH1, SH2, SH3 and SH4, the pulse widths p1, p2, p3 and p4 are set longer, respectively. The X driver has therein an unrepresented PWM circuit which sets the pulse widths p1 to p4 in accordance with the PWM clock setup signal SP. In accordance with the setup pulse widths p1 to p4, the X driver 7 generates a drive voltage waveform and drives each light emitting element.

By driving in this manner, similar to the third embodiment, a higher contrast is given to the gradation block having a larger histogram so that the input image can be displayed always at a good contrast matching the input image. However, in order to obtain a sufficient number of gradations, this configuration requires a sufficiently fast pulse width modulation clock signal.

Fourth Embodiment

Pulse Width Modulation Priority Type Multivalue PWM (combined type)

Figure 18:
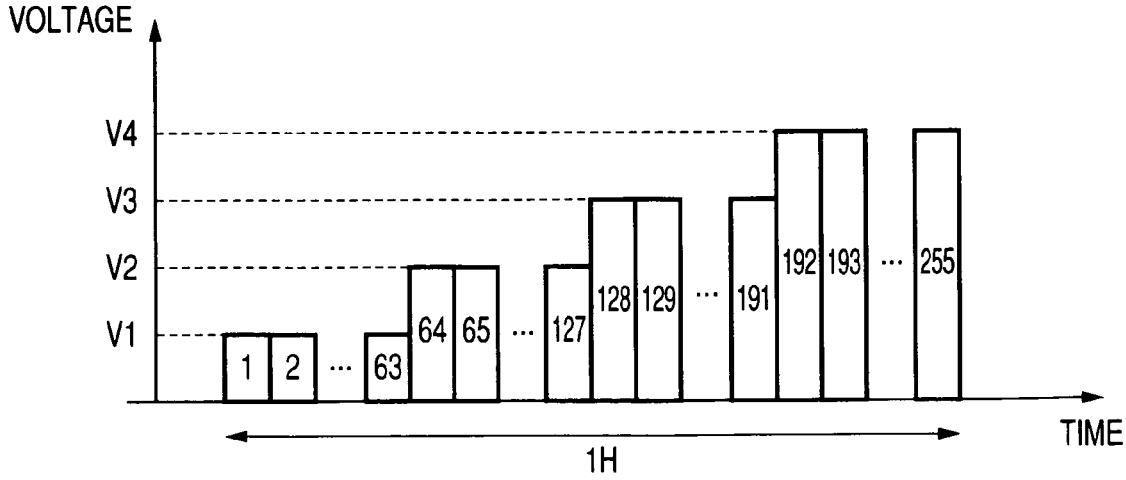
FIG. 18 shows drive voltage waveforms according to a fourth embodiment.

In the fourth embodiment of the present invention, description will be made on an example of driving a light emitting element by a voltage waveform shown in FIG. 18.

In this embodiment, the gradation is divided into four blocks "0" to "63," "64" to "127," "128" to "191" and "192" to "255," and each gradation block has a voltage waveform having a different voltage. It is assumed that the pulse width of one slot is the same in each gradation block. In FIG. 18, it is set as V1−0=V2−V1=V3−V3=V4−V3 (equal voltage division). In this case, it is assumed that a polygonal line approximate to the standard gamma characteristics (e.g., $\gamma$=2.2) is obtained.

The driver block diagram of this embodiment is the same as the block diagram of FIG. 1. In the first embodiment, the decoder 1 and counters 2 to 5 count the cumulative histograms. In this embodiment, the histograms are counted in accordance with the inputs and outputs of the decoder 1 shown in FIG. 14.

The count histograms are converted into the voltage setup signal SV by the voltage setup unit 6, and the X driver 7 sets the potential values V1 to V4 to generate the drive voltage waveforms. In this case, the potential values V1 to V4 are set so that the larger the histograms SH1, SH2, SH3 and SH4, the potential values V1, V2, V3 and V4 become higher, respectively.

By driving in this manner, similar to the third embodiment, a higher contrast is given to the gradation block having a larger histogram so that the input image can be displayed always at a good contrast matching the input image.

As described above, as the present invention is adopted, it is not necessary to use a gamma correction table so that the circuit scale can be made small. Since digital data conversion is not used, insufficient gradation of gamma correction can be avoided.

This application claims priorities from Japanese Patent Application Nos. 2004-067459 filed on Mar. 10, 2004 and 2005-055663 filed on Mar. 1, 2005, which are hereby incorporated by reference herein.

What is claimed is:

1. An image display apparatus comprising:

a plurality of display elements;

a drive unit for generating a drive pulse signal to be supplied to each of the display elements on the basis of input image data, a pulse width of the drive pulse signal being represented by a plurality of sub pulse widths Pj (j=1~m) corresponding to a plurality of (m) gradation blocks Bi (i=1~m) obtained by dividing the range of possible gradation values of the input image data, wherein the pulse width of the drive pulse signal generated for any gradation value belonging to each gradation block Bi is given by the following formula:

$$i\Sigma Pj(\text{for } Bi)j=1$$

where each of i and j is a positive integer equal to or less than m, and a waveform area of the drive pulse signal monotonically changes in accordance with the magnitude of the gradation value;

a histogram creation unit for creating a histogram indicative of a degree of each gradation block by counting for each gradation block the number of image data having any gradation value belonging to an identical gradation block from at least one frame of image data; and a control unit operable to set the sub pulse width corresponding to each gradation block, in accordance with the magnitude of the degree of that gradation block in the histogram so that if a degree of a gradation block is larger than those of the other gradation blocks, a slope of an intensity/gradation characteristic of each of the display elements supplied with the drive pulse signal for that gradation block is increased and if the degree of the gradation block is smaller that those of the other gradation blocks, the slope of the intensity/gradation characteristics of each of the display elements supplied with the drive pulse signal for that gradation block is decreased.

2. The image display apparatus according to claim 1, wherein each of the display elements comprises an electron emitting element for emitting electrons while the drive unit supplies the drive pulse signal thereto.

3. An image display apparatus comprising:

a plurality of display elements;

a drive unit for generating a drive pulse signal to be supplied to each of the display elements on the basis of input image data, a pulse width of the drive pulse signal being represented by a plurality of sub pulse widths Pj (j=1~m) corresponding to a plurality of (m) gradation blocks Bi (i=1~m) obtained by dividing the range of possible gradation values of the input image data, wherein the pulse width of the drive pulse signal generated for any gradation value belonging to each gradation block Bi is given by the following formula:

$$i\Sigma Pj(\text{for } Bi)j=1$$

where each of i and j is a positive integer equal to or less than m, and a waveform area of the drive pulse signal monotonically changes in accordance with the magnitude of the gradation value;

a histogram creation unit for creating a histogram indicative of a degree of each gradation block by counting for each gradation block the number of image data having any gradation value belonging to an identical gradation block from at least one frame of image data; and a control unit operable to set the sub pulse width corresponding to each gradation block, in accordance with the magnitude of the degree of that gradation block in the histogram.

* * * * *